US005259128A

United States Patent [19]

Howell

[11] Patent Number: 5,259,128

[45] Date of Patent: Nov. 9, 1993

[54] SNOWSHOE

[75] Inventor: Richard J. Howell, Stowe, Vt.

[73] Assignee: Stowe Canoe and Snowshoe Company, Inc., Stowe, Vt.

[21] Appl. No.: 649,058

[22] Filed: Feb. 1, 1991

[51] Int. Cl.[5] ..... A43B 5/04; A44B 11/12

[52] U.S. Cl. ..... 36/122; 36/124; 24/200

[58] Field of Search ..... 36/122, 123, 124, 125; 280/11.3, 611, 619, 620, 621; 24/170, 172, 193, 200

[56] References Cited

U.S. PATENT DOCUMENTS

| | | | |
|---|---|---|---|
| 665,430 | 1/1901 | Gump | 24/200 |
| 1,074,498 | 9/1913 | Eiker | 24/200 |
| 1,187,817 | 6/1916 | Collis | 280/11.3 |
| 2,385,944 | 10/1945 | Ruecker | 36/125 |
| 2,738,596 | 3/1956 | Walsh | 36/62 |
| 2,821,031 | 1/1958 | Howe | 36/125 |
| 4,085,529 | 4/1978 | Merrifield | 36/125 |
| 4,881,303 | 11/1989 | Martini | 24/170 |

FOREIGN PATENT DOCUMENTS

| | | | |
|---|---|---|---|
| 980826 | 12/1975 | Canada | 36/125 |

*Primary Examiner*—Steven N. Meyers
*Assistant Examiner*—M.D. Patterson
*Attorney, Agent, or Firm*—Paul M. Craig, Jr.

[57] ABSTRACT

A snowshoe binding providing facilitated entry and exit which includes a support housing made of semi-rigid material having rearwardly extending lateral support arms integral with the support housing to increase lateral support. The toe binding utilizes a yoke assembly that requires only a single, relatively short strap extending both in the transverse as well as forward direction by the use of a yoke member which permits the strap to remain flat for wearer comfort. By the use of a modified buckle, the free end of the heel strap extends toward the body so that ergonomic cinching is possible. Additionally, facilitated attachment and detachment of a crampon without the use of tools is made possible by the particular pivotal arrangement of the toe stop of the toe binding part.

44 Claims, 3 Drawing Sheets

FIG. 1
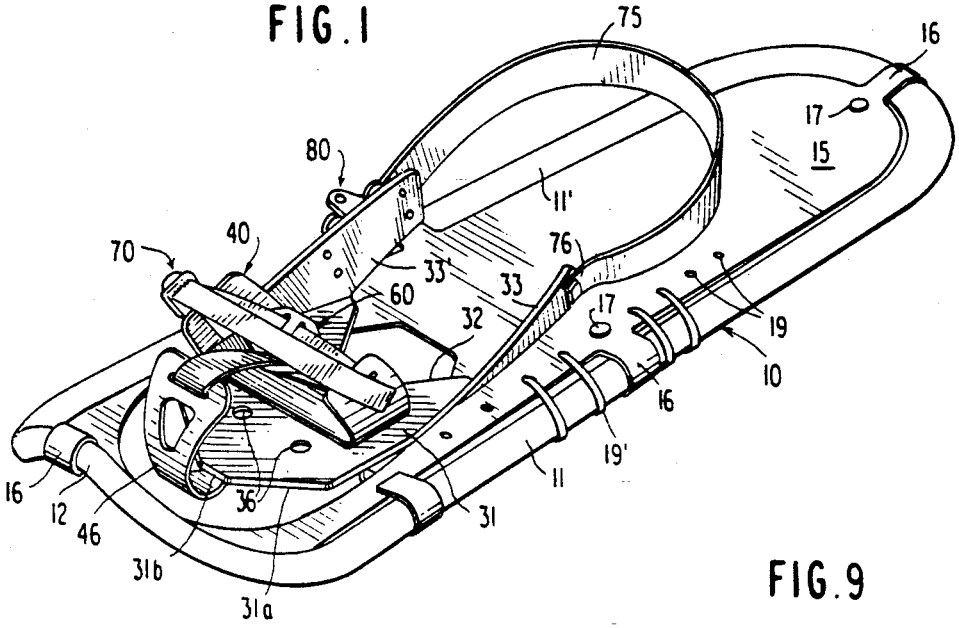
FIG. 9
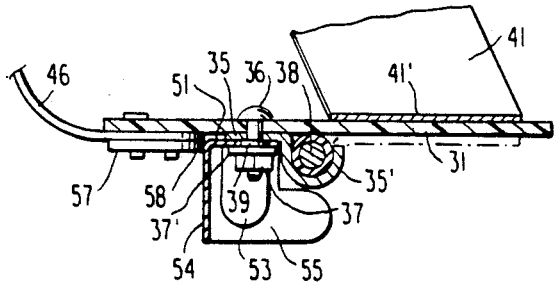
FIG. 7
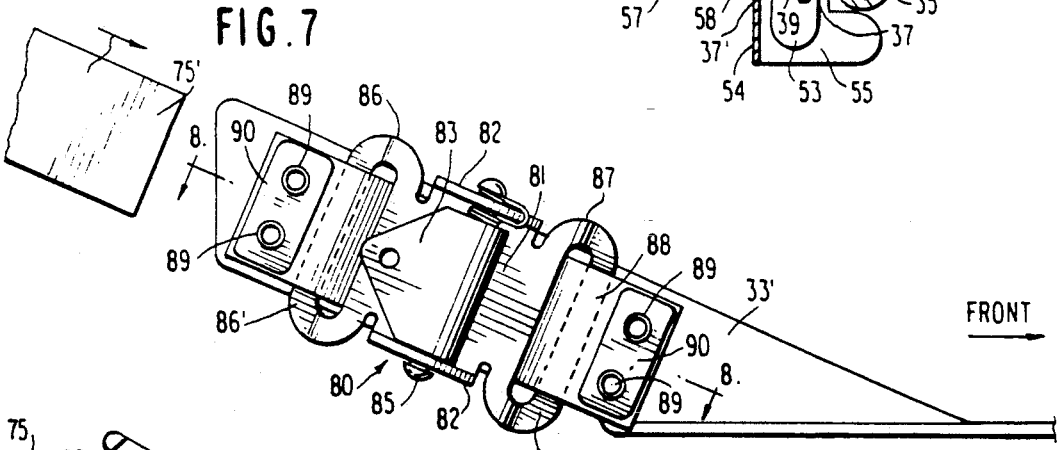
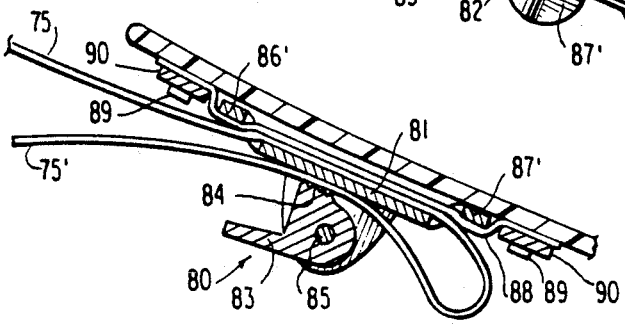
FIG. 8

FIG. 2
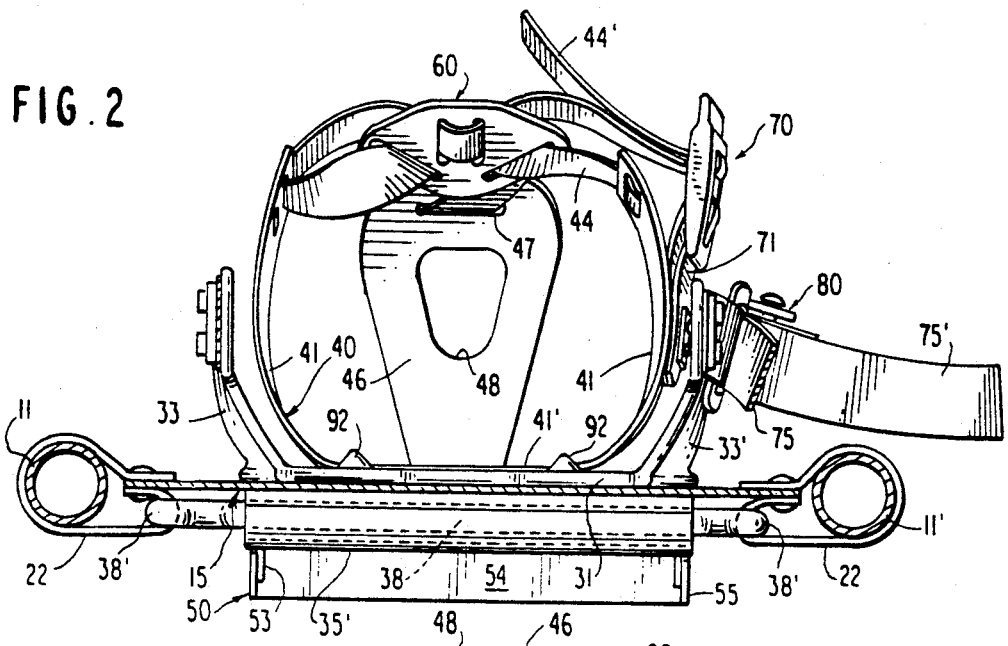
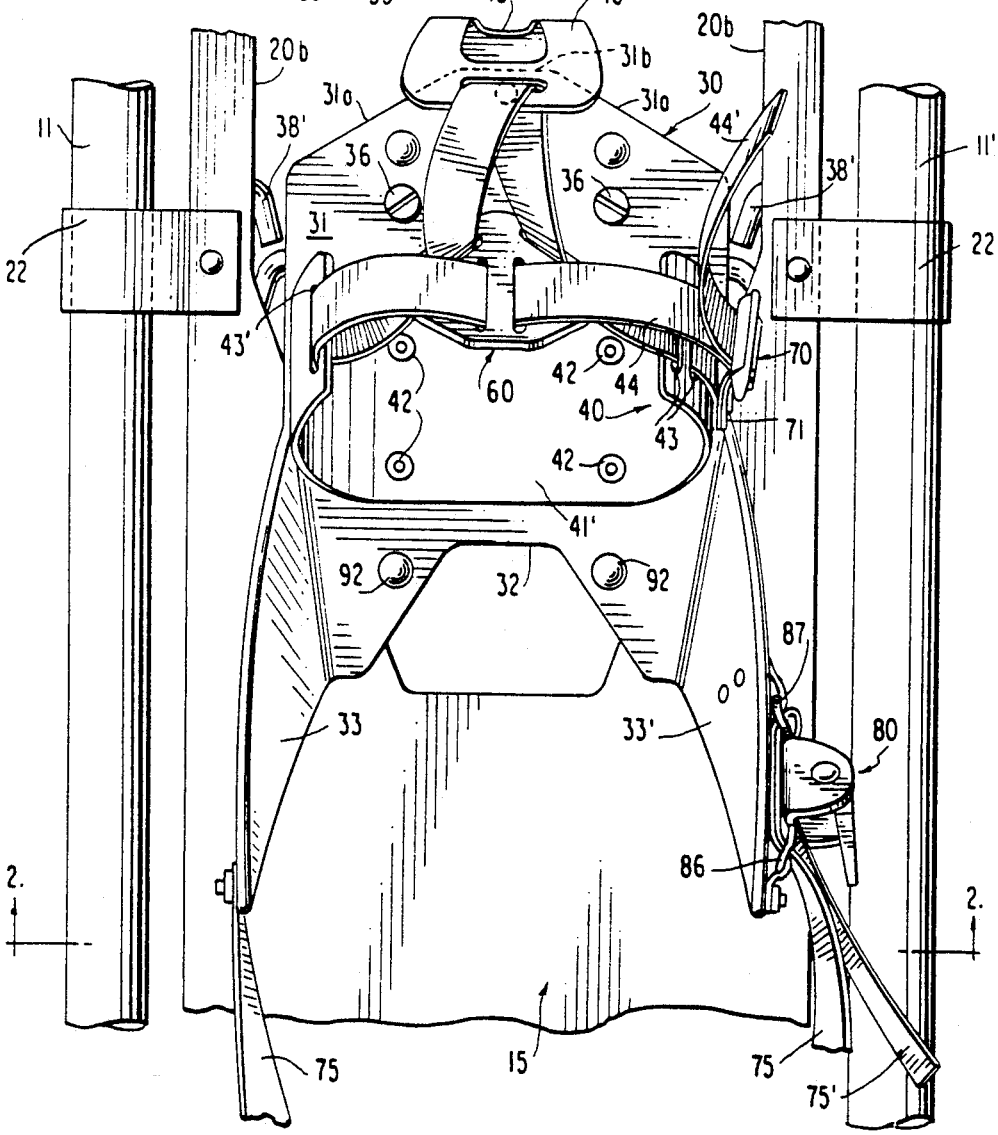
FIG. 3

FIG. 4
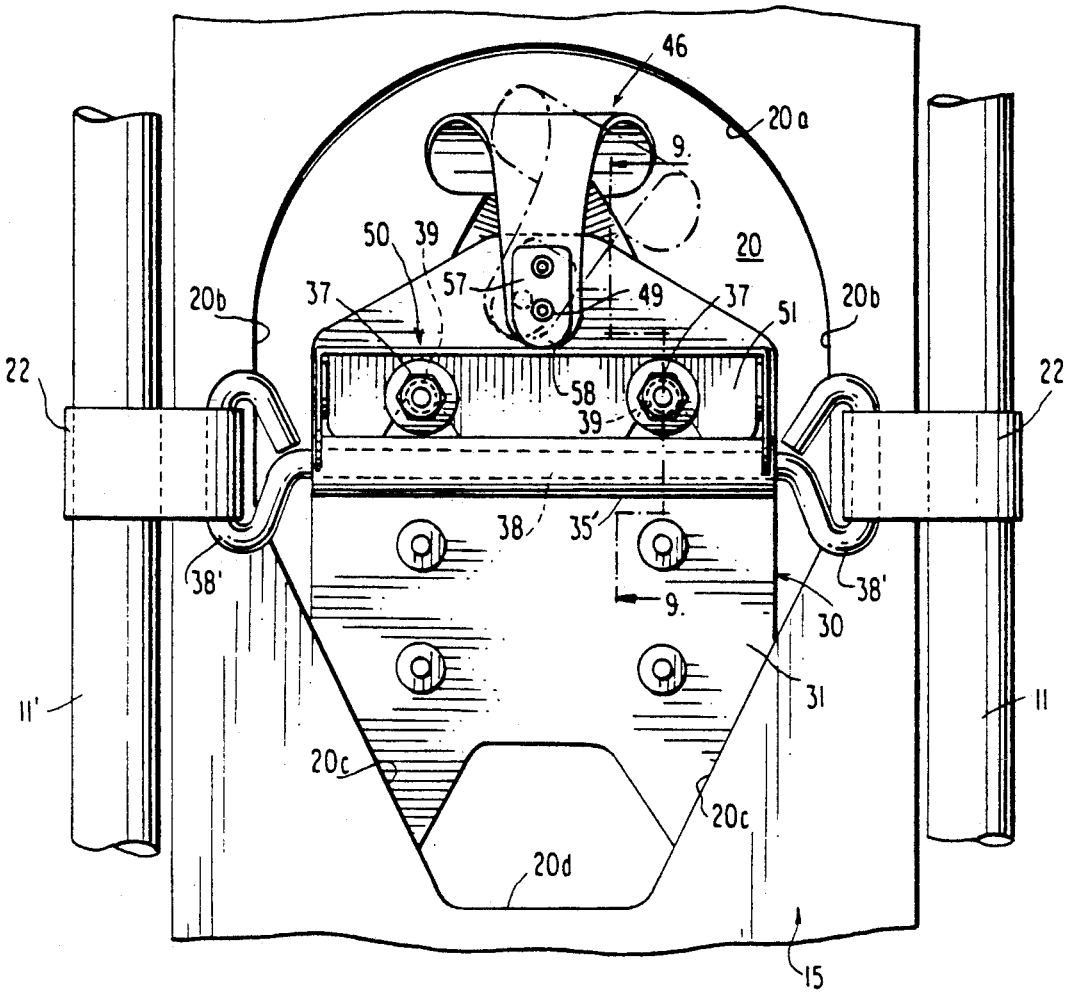
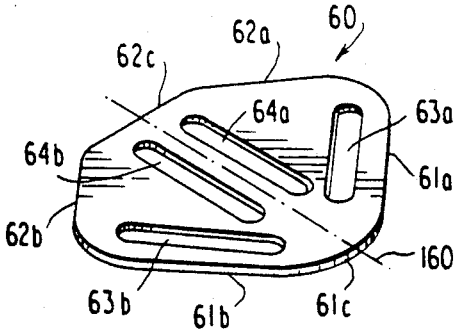
FIG. 5
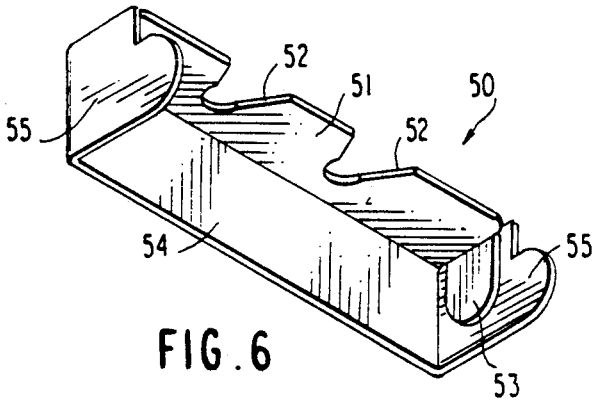
FIG. 6

SNOWSHOE

FIELD OF INVENTION

The present invention relates to a snowshoe and more particularly to an improved binding for a snowshoe.

BACKGROUND OF THE INVENTION

Snowshoes have been used for more than 1,000 years to move in snow and on ice. Commander Peary already used snowshoes in his conquest of the North Pole. Originally, rawhide straps were used for the webbing of the snowshoes with the bindings formed by a number of loose straps.

One must differentiate between snowshoe equipment, cross-country ski equipment, downhill ski equipment and, more recently, snow board equipment. Cross-country ski equipment involves relatively light-weight narrow skis and relatively light-weight cross-country shoes for use with bindings specifically designed for the cross-country skis and shoes (for example, U.S. Pat. No. 4,142,734). Downhill ski equipment involves relatively wider and heavier skis than cross-country skis, and relatively heavy boots to provide support which are made at present from plastic materials with relatively thick standard soles for use with ski bindings, normally with safety bindings specifically designed for these types of boots, of which a large variety exist (for example, U.S. Pat. Nos. 1,815,168; 2,072,477; 4,846,492; 4,871,186 and 4,893,831). Snow boards are of more recent origin, whereby both feet rest on a single board with at least one step-in binding for one boot (for example, U.S. Pat. No. 4,973,073). Snowshoes, on the other hand, are used to walk, respectively, run on snow and with the use of crampons can be used even to climb fairly steep inclines on snow and/or icy surfaces Because of the different functions of these various equipments, their design including bindings and footwear are specific to meet the differing demands and therefore are normally not applicable interchangeably. Relatively complicated bindings have been proposed heretofore to permit use for downhill and cross-country skiing, as exemplified by U.S. Pat. Nos. 2,072,477; 4,002,354; 4,152,009 and 4,674,766. However, they have found relatively little acceptance so far in the marketplace where single-use equipment is preferred.

Early snowshoe bindings utilizing leather straps which flopped around and hung loose, were rather cumbersome in use. Moreover, the lacing of the toe-cord with the use of rawhide or neoprene straps imposed severe limitations from a design point of view because of sag in the fore and aft directions. Over the years, snowshoes have undergone changes. For example, in lieu of the wooden frame, metal frames even with solid decking have already been proposed (U.S. Pat. No. 4,041,621). Additionally, to improve the usability of the snowshoe, a pivotal arrangement of the footwear has been proposed, for example, in U.S. Pat. Nos. 1,054,352; 2,420,621; 2,738,596; 2,987,834; 3,344,538; 3,802,100 and 4,259,793. Various snowshoe bindings have also been proposed heretofore to improve convenience and/or achieve improved performance as exemplified, for example, by U.S. Pat. Nos. 1,156,174; 1,523,222; 2,385,944; 2,821,031; 2,987,834; 3,555,707; 3,744,162; 3,885,327; 3,965,584 and 4,259,793. However, certain limitations still continue to beset the presently available snowshoes which involve, inter alia, problems of getting in and out of the snowshoe bindings, even to the point where snowshoe enthusiasts become sufficiently disenchanted to drop the snowshoe activities.

Sag in the webbing or lacing also poses a problem which affects the usefulness of the snowshoe Pads of imperforate flexible material have already been proposed in U.S. Pat. No. 4,259,793 to prevent the snowshoe from deeply penetrating the snow; however, the binding of this patent continues to be supported by webbing.

The need for crampons with snowshoes depends on the snow, respectively, ice conditions of the travelled surfaces as well as on the steepness of the terrain and whether one wants to climb or glissade downhill.

It is well known that when climbing, crampons are very useful. There are times, however, when snowshoes are easier to control without crampons, such as when glissading downhill in a semi-telemark-like technique. When one is using crampons, performance and snowshoe control can also be enhanced using a specific type of crampon that is optimally suited for the type of snow conditions or type of snowshoe use. For example, one type of crampon with short teeth is best suited for fine-grain, compact density snow, while another type—with much longer teeth—is better suited for loose grain or loose, granular-type snow conditions. The length of the teeth are also a function of the steepness of the terrain: the longer the teeth, the better the grip into the snow for more resistance against the resultant forces of gravity. It is therefore necessary, when climbing mountains, to use short teeth crampons at the base and then switch to long-toothed crampons near the summit Heretofore, rapid change in the cold has been difficult or impossible depending on the degree of discomfort the user is willing to endure. Further, different types of snowshoe activities suggest the use of different crampon materials Plated steel crampons are well-suited for public utility workers who use snowshoes because durability and reliability are of key importance. On the other hand, snowshoe racers prefer the use of aluminum crampons, trading-off long-term durability for the immediate benefits of weight reduction and running speed. Being able to optimize crampon type for different snowshoe uses, without a long assembly and disassembly period, can be beneficial to the users. Heretofore, the removal of crampons, for example, for glissading has been very difficult in the cold with wrenches and screwdrivers, often requiring the removal of gloves. Often, because of the inherent difficulties of removing crampons, snowshoers will forego their removal and therefore sacrifice efficient descent. The prior art crampon attachment thus represented a serious drawback in the optimization of crampon use.

Another problem with the prior art snowshoe bindings resided in the inadequate support, particularly lateral support, during traversing across hills and aggressive scrambling where the swing-weight (polar moment of inertia) does not follow the inertial resistance (changes in angular momentum) of the human leg and thus becomes unstable dynamically and is therefore less controllable to the user.

A further shortcoming of some prior art snowshoe bindings can be found in the strap arrangements with or without the use of buckles which permit a cinching only in a non-ergonomic manner.

SUMMARY OF THE INVENTION

It is a principal object of the present invention to provide an improved snowshoe and snowshoe binding which avoids the aforementioned shortcomings and drawbacks encountered with the prior art.

The underlying problems are solved according to the present invention in that the snowshoe binding includes a support housing of semi-rigid material with lateral support arms on both sides which extend upwardly rearwardly a predetermined distance while undergoing a twist from an oblique to a generally vertical position. The lateral support arms thereby provide lateral stability and additionally hold the footwear securely when traversing across steep terrain and during aggressive scrambling. The use of a semi-rigid material for the support housing including the lateral support arms assures adequate lateral support, yet permits adaptation to different boot sizes. Contrary, for example, to downhill ski equipment, the footwear normally used with snowshoes consists of a wide range of commercially available boots, such as rubber and leather pack boots, hiking boots, mukluks or hard-shell climbing boots. The toe support of the binding in accordance with the present invention involves a novel yoke assembly which allows the use of a single adjustable toe strap. The yoke member according to this invention thereby alters the directional flow of the adjustable toe strap from transverse to longitudinally direction and vice versa in such a manner that the strap can remain flat, thereby improving the comfort for the snowshoer. Additionally, the yoke arrangement in accordance with the present invention enables a unique control of lateral and fore-and-aft directional cinching of the toe strap utilizing only a single strap. It constitutes an extraordinarily simple construction that eliminates two or more buckles and/or several tied-off strap sections that complicated prior bindings.

According to still another feature of the present invention, the crampon can be readily attached, respectively, detached, by a mere pivotal movement of the pivotal toe stop which, for that purpose, extends around the forward edge of the sole plate and is pivotally attached thereto in such a manner that a locking part, for example, a plate-like locking member or a downwardly projecting lug for locking the crampon in place can be pivoted into and out of the operative position by merely pivoting the toe stop. The crampon can thus be attached, respectively, detached by pushing down to clear detents or projections in the underside of the binding on both sides of the center position of the toe stop and by simultaneous pivoting of this toe stop without the need of tools, such as screwdrivers and pliers, all of which can be realized according to this invention without the need for the snowshoer to take off the gloves. Conventional detents or projections are thereby provided on the underside of the binding, for example, in the form of pressed-out dimples, on both sides of the center position of the toe stop member to avoid inadvertent rotation thereof during use.

According to still another feature of the present invention, a modified buckle is used which allows reversal of the direction of the heel strap so that the snowshoer, when cinching the heel strap, is able to pull the strap toward the body instead of away from the body. This effectively provides an ergonomically much easier manner of cinching the heel strap. The modified buckle in accordance with the present invention thereby has a two-stage latching action which allows free-flowing strap movement.

U.S. Pat. No. 2,511,087 discloses a harness or binding which consists of an elongated piece of flexible, pliable material that includes a bottom or heel section, a reduced toe portion and an upper support section, whereby the upper portion is superimposed on the heel support section by being bent through 180°. The upper supporting section is thereby provided with an elliptical opening to accommodate the wearer's shoe, a fingergrip extension being provided at the end of the section to assist insertion of the shoe. However, the binding of this patent is not only relatively complicated in structure but also entails considerable disadvantages as regards ease of access into and exit from the binding.

BRIEF DESCRIPTION OF THE DRAWINGS

These and other objects, features and advantages of the present invention will become more apparent from the following description when taken in connection with the accompanying drawing which shows, for purposes of illustration only, one embodiment in accordance with the present invention, and wherein:

FIG. 1 is a perspective view of a snowshoe with a binding in accordance with the present invention;

FIG. 2 is a cross-sectional view, taken along line 2—2 of FIG. 3;

FIG. 3 is a top plan view on the binding in accordance with the present invention;

FIG. 4 is a bottom plan view of the binding in accordance with the present invention;

FIG. 5 is a perspective view of the yoke member in accordance with the present invention;

FIG. 6 is a perspective view of the attachable crampon in accordance with the present invention;

FIG. 7 is a side elevational view of the modified buckle in accordance with the present invention for use with the heel strap;

FIG. 8 is a cross-sectional view taken along line 8—8 of FIG. 7; and FIG. 9 is a longitudinal vertical cross-sectional view taken along line 9—9 of FIG. 4 and illustrating a part of the binding in accordance with the present invention.

DETAILED DESCRIPTION OF THE DRAWINGS

Referring now to the drawing wherein like reference numerals are used throughout the various views to designate like parts, the frame generally designated by reference numeral 10 (FIG. 1) of the snowshoe in accordance with the present invention may be of any known construction, such as wood or plastic, but is preferably of tubular construction utilizing high-strength lightweight aircraft aluminum material for its tubular member. The frame 10 is of generally rectangular shape, as viewed in plan view, with the longitudinal legs 11 and 11' thereof slightly tapering toward one another in the rearward direction and with the front and rear being curved, whereby the rounded front section 12 of the frame 10 extends upwardly as best shown in FIG. 1.

In order to avoid problems which may be encountered with webbing formed by straps, the present invention preferably utilizes a decking generally designated by reference numeral 15 which is made from relatively strong plastic material and extends either in one piece or of several sections on the inside of the frame 10. Outwardly extending strap portions 16 of the decking 15 are looped about the tubular frame 10 and are then riveted together by commercially available apertured rivets 17 thereby effectively connecting together the decking 15 and the tubular frame. In conjunction with holes 19 provided along the entire circumference of the decking 15, the apertured rivets 17 can also be used for lacing the decking 15 to the frame 10 by means of conventional leather or plastic straps. The holes 19 for the lacing as also the straps 19' are shown only schematically and only over a portion of the decking; however, it is understood that the holes 19 and straps 19', which indicate where the helically arranged lacing will go, extend over substantially the entire circumferential area of the decking.

Within the area of the binding in accordance with the present invention, the decking 15 is provided with an opening generally designated by reference numeral 20 which, as shown in FIG. 4, is defined by a semi-circularly shaped front part 20*a* adjoined by rectilinear parts 20*b* that continue into tapering parts 20*c* interconnected by the connecting part 20*d*. In other words, the configuration of the opening 20 is defined by surfaces 20*a*, 20*b*, 20*c* and 20*d* which permit pivotal movement of the binding through the opening 20*a*, 20*b* in the forward direction, but limits pivotal movement of the binding in the opposite direction.

The support housing generally designated by reference numeral 30 of the binding in accordance with the present invention includes a sole plate part 31 of generally rectangular shape which tapers in the toe area at 31*a* to terminate in a straight or slightly curved end section 31*b* (FIG. 3). At the rear end of the sole plate 31, a more or less trapezoidally shaped cutout 32 is provided for weight reasons (FIG. 3). The lateral support arms 33 and 33', which are part of the support housing 30, are integral with the sole plate part 31. As can best be seen from FIGS. 1, 2 and 3, the lateral support arms 33 and 33', which are of substantially constant width, extend rearwardly upwardly with a twist from the initial oblique position so that the ends thereof are substantially vertical (FIGS. 3 and 4). This shape, in conjunction with the semi-rigid material used for the support housing 30, also permits an adaptation to different shoe sizes. A preferred semi-rigid material is a plastic alloy material consisting of Nylon 12, as commercially available under the tradename "Hüls L 2120" which is a relatively rigid material with limited flexibility to assure lateral stability of the footwear.

To allow for pivotal movement of the support housing 30, a base plate member 35 (FIG. 9) is attached to the bottom of the sole plate 31 by screws 36 nd nuts 37. The relatively short base plate 35 shown in FIG. 9 forms a sleeve-like bearing portion 35' for pivot member 38 which is secured to the longitudinal frame members 11 and 11' preferably by means of decking strap portions 22 which engage in eye portions 38' of the pivot member 35 (FIG. 4). The sagging problems encountered with strap-laced pivotal supports are effectively avoided thereby. The base plate 35 may also be longer toward the rear, as indicated in dash-and-dotted lines in FIG. 4, i.e., the base plate 35 may be more or less coextensive with the sole plate part 31 to extend underneath a substantial part of the sole plate part 31 to the rear of bearing portion 35' so that the sleeve-like bearing portion 35' can then be secured at the sole plate part 31 by rivets or by screws and nuts on both sides of the bearing portion 35' and together with the sole plate part 31 forms a closed bearing housing. With the use, for example, of self-locking nuts 37 together with fender washers 37' and standard washers 39, a space of predetermined fixed width can be maintained between the bottom surface of the base plate 35 and the upper surface of the fender washer 37' (FIG. 9) to accommodate a removable crampon generally designated by reference numeral 50 (FIG. 6). The crampon 50 includes a flat base portion 51 provided with two cutouts 52 spaced corresponding to the spacing of the standard washers 39 and having a tapering entry section terminating in a semi-circular end portion to fit around the standard washers 39 and above the fender washers 37'. The base portion 51 which is intended to be inserted between the fender washer 37' and the bottom surface of the base plate 35 as shown in FIG. 9, includes bent-down tabs 53 along the sides thereof whereas a downwardly extending ledge portion 54 which may be provided with any known teeth, serrations or the like (not shown) at the bottom surface thereof constituting the crampon surface, properly speaking, extends with its side portions 55 over the tabs 53 to which they are fixed, e.g., by riveting. As a result thereof, the crampon 50 constitutes a relatively rigid part which can be readily assembled onto and disassembled from the snowshoe as will be explained more fully hereinafter. Moreover, different types of crampons may be interchanged as the need arises.

The toe binding part generally designated by reference numeral 40 forms a yoke assembly, which includes a generally semi-circularly shaped flexible foot support member 41 forming an instep part and made from suitable plastic material that includes a base portion 41' secured by rivets 42 to the sole plate 31. At its two curved upper ends (FIGS. 2 and 3), the foot support member 41 is provided with two slots 43, respectively, one slot 43', whereby a toe strap 44 is attached to the right part of the toe support member 41 as viewed in FIG. 3 preferably together with the buckle 70 as will be described more fully hereinafter. A more or less diamond-shaped yoke member generally designated by reference numeral 60 (FIG. 5) whose shape is defined by forwardly slanting sides 61*a* and 61*b* interconnected by surface 61*c* and by rearwardly slanting sides 62*a* and 62*b* interconnected at 62*c*, is provided with two slots 63*a* and 63*b* extending substantially parallelly to the side surfaces 61*a* and 61*b* and with two further slots 64*a* and 64*b* extending at right angle to the surface 62*c* and symmetrical with respect to the center longitudinal plane 160 of the yoke member 60. The slots 63*a* and 63*b* thereby form an angle preferably of about 45° with respect to the center longitudinal plane 160. The strap 44, after passing through the slots 43 of the right part of the foot support member 41, extends from below through the slot 63*b* (FIG. 3), thereby changing direction through at least about 90° forwardly toward the toe stop generally designated by reference numeral 46; the forwardly extending toe strap 44 then extends from below or above through the slot 47 of the pivotal toe stop 46 and, as it emerges, extends generally rearwardly and passes through slot 63*a* from above to change again direction through at least about 90°. The strap 44 then extends from below through the slot 43' in the left part of the foot support member 41 and upon reversal of direction extends transversely from above through slots 64*a* and 64*b* as shown in FIG. 3 to the buckle 70 which is a conventional buckle made, for example, by the Fastex Company (U.S. Pat. No. 4,171,555) and provided with three slots, whereby the first and middle slot are used to fasten the buckle onto the right part of the foot support member 41 jointly with fixing the end of strap 44 to this part (FIG. 2) while the middle and third slot are used for the passage of the strap 44. This arrangement offers a number of significant advantages. It permits ready tightening of the toe strap 44. The yoke 60 which alters the directional flow of the adjustable toe strap allows the use of a single, relatively short strap 44 which remains flat and permits unique lateral as well as fore-and-aft directional cinching while equalizing the forces in the different parts of the strap. The yoke arrangement according to this invention thus obviates the more complicated prior art solutions involving more than one buckle and/or several tied-off strap sections more difficult to handle.

The heel binding includes a heel strap 75 fixed to the support housing 30. One end of the heel strap is thereby fixed to the end of the left lateral support arm 33 (FIG. 3) and the other end terminates in a buckle generally designated by reference numeral 80 which permits reversal of the direction of the nylon heel strap 75 so as to permit the user, when cinching the strap, to pull the strap toward the body instead of away from the body. Pulling strap 75 toward the body is ergonomically much easier. The buckle 80 (FIGS. 7 and 8) includes a base portion 81 which floats freely and is held in place by a short fastening strap section 88 that passes through the lateral eyes 86 and 87 integral with the base portion 81 and is then fastened at the lateral arm 33' by rivets 89 in conjunction with fastening plates 90. As can be seen from FIGS. 7 and 8, the outer part 86' and 87' of each eye 86 and 87 is offset with respect to the plane of the base portion 81 which is an important feature because it allows the end of the strap 75 to extend through these eyes 86 and 87 over the fastening strap 88 in the space between the strap 88 and the buckle base portion 81, to thereafter reverse direction and pass through the space between the outer surface of the base portion 81 and the teeth 84 of the spring-loaded latching member 83 pivotally supported on pivot 85. As can be seen in FIGS. 7, 8 and 3, the free end 75' of the heel strap 75 extends rearwardly so that it can be cinched in the direction toward the body.

Attachment and detachment of the crampon 50 is readily achieved merely by overcoming the detents or projections (not shown) provided at the bottom surface of the sole plate part 31 or at the base plate 35 by a downwardly directed force and by pivoting the toe stop member 46 to one side, indicated in FIG. 4 in dash-and-dotted line which causes the rounded-off locking surface 58 of the plate-like locking member 57 at the bottom of the pivotal toe stop member 46 to move out of the way of the crampon 50, thereby permitting the crampon 50 to be removed by sliding it forwardly until it can be lifted out of the installed position. This is another significant feature of the snowshoe in accordance with the present invention because it permits selective use of the crampon as needed and facilitates attachment, respectively, detachment of the crampon and/or interchange of different types of crampons without great difficulty and without any special tools, even in extremely cold weather. Small projections 92 (FIG. 2) are provided on the sole plate part 31 which extend through corresponding holes in the base portion 41' for engagement with the boot sole.

The snowshoe in accordance with the present invention thus offers a number of significant advantages which improve both the convenience and performance thereof. The convenience is greatly increased by facilitated entry access into the binding utilizing only one toe strap and one heel strap and by interchangeability or removal of crampons. The single toe strap in the yoke assembly represents a significant improvement in that area of the binding. The same is true of the heel strap in conjunction with the support arms and the heel strap buckle modified in accordance with the present invention which permits ergonomical cinching of the heel strap. Of course, for extreme climbing conditions, an auxiliary kick-in strap can also be used without difficulty by attaching the same to the middle of the heel strap and extending it around the foot. The same kick-in strap may also be useful with certain special footwear devoid of heel projections.

The performance of the snowshoe in accordance with the present invention is also greatly improved because it provides greater control. The lateral support by the semi-rigid lateral support arms increases lateral stability to securely hold the footwear when traversing and/or aggressively scrambling. The solid binding housing distributes the high stress area of the solid pivot rod and thereby isolates it from the user's foot. In the toe area, the foot support member 40 in conjunction with the single toe strap also improves toe support as well as automatic adjustability with uniform force distribution in the toe strap. The solid binding provides a stable platform from which interchangeability of crampons can be effected. Additionally, the connection of the heel strap buckle to the lateral support arm assures a force distribution through the lateral support arm in lieu of a concentration of pressure in one area.

Another important feature of the snowshoe binding in accordance with the present invention resides in the fact that normally only two relatively short straps are needed in the binding which, as a result of the particular arrangement of this invention, are now in a ready-to-use, upright mode for use by the snowshoer. As is also quite apparent, entry and exit from the binding in accordance with the present invention is vastly easier than realizable with the prior art bindings.

While I have shown and described only one embodiment in accordance with the present invention, it is understood that the same is not limited thereto but is susceptible of numerous changes and modifications as known to those skilled in the art, for example, a wood or metal frame may be used in lieu of the tubular frame and/or rawhide webbing may be used instead of plastic decking where snow accumulation on top of the decking is of importance. Furthermore, the binding in accordance with the present invention may also utilize any other commercially available buckles which achieve the basic goals of the heel support. Moreover, the yoke member as well as the modified buckle in accordance with the present invention have usefulness apart from the snowshoe of this invention. For example, the modified buckle in accordance with the invention may be used with camping gear, luggage racks, safety harnesses and the like, while the yoke member according to this invention may be useful with camping gear, tents, harnesses and the like. I therefore do not wish to be limited to the details shown and described herein but intend to cover all such changes and modifications as are encompassed by the scope of the appended claims.

I claim:

1. A snowshoe, comprising frame means, and binding means for a boot including support housing means of semi-rigid material and toe binding means having a toe strap, said support housing means having lateral support arms extending rearwardly upwardly a predetermined distance, said support housing means together with its rearwardly upwardly extending lateral support arms of semi-rigid material providing lateral support to increase lateral stability and thereby to securely hold a wearer's footwear when traversing and scrambling, and a heel strap attached to the lateral support arms near the free ends thereof.

2. A snowshoe according to claim 1, wherein the lateral support arms undergo a twist from an inclined position toward an at least nearly vertical position at their free ends, and wherein the heel strap is secured to at least one lateral support arm by way of a buckle means.

3. A snowshoe according to claim 2, wherein the heel strap undergoes reversal of direction in the two-stage buckle means so that the free end of the heel strap extends toward the body, and wherein said buckle means includes a base member and eyes on both sides of the base member with the outer part of each eye offset from the plane of the base member, a fastening strap for floatingly securing said buckle means at the other lateral support arm with the fastening strap extending through said eyes from above and underneath said base member so that the free end of the heel strap can extend over said fastening strap underneath the base member and upon reversal of direction to return above the base member in the space between the top surface of the base member and a latching means secured to said base member.

4. A snowshoe according to claim 1, wherein said toe binding means includes a toe stop member and yoke means to enable lateral as well as fore-and-aft directional cinching of the single toe strap.

5. A snowshoe according to claim 4, further comprising means including said toe stop member for detachably connecting a crampon to the bottom of the binding means.

6. A snowshoe according to claim 5, wherein said toe stop member extends about the front of the support housing means and is provided at its underside with locking means for the crampon, and means pivotally connecting the toe stop member to the support housing means.

7. A snowshoe according to claim 1, further comprising means pivotally supporting said support housing means about a substantially transverse axis to enable limited pivotal movement of the support housing means.

8. A snowshoe comprising frame means, and binding means for a boot including support housing means of semi-rigid material, said toe binding means including a toe strap and a toe stop member, and further comprising means including said toe stop member for detachably connecting a crampon to the bottom of the binding means.

9. A snowshoe according to claim 8, wherein said toe stop member extends about the front of the support housing means and is provided at its underside with locking means for the crampon, and means pivotally connecting the toe stop member to the support housing means.

10. A snowshoe according to claim 9, wherein said toe binding means includes yoke means to enable lateral as well as fore-and-aft directional cinching of the toe strap.

11. A snowshoe, comprising frame means and binding means for a boot including support housing means of semi-rigid material having a sole plate and rearwardly upwardly extending lateral support arms, said support housing means together with its rearwardly upwardly extending lateral support arms of semi-rigid material providing lateral support to increase lateral stability and thereby to securely hold a wearer's footwear when traversing and scrambling, toe binding means fixed to said support housing means, said toe binding means including foot support means, a toe stop member and a yoke-like strap assembly between said foot support means and said toe stop member, said yoke-like strap assembly including a toe strap and yoke means to enable lateral as well as fore-and-aft directional cinching of the toe strap, and a heel strap support at the lateral support arms.

12. A snowshoe according to claim 11, wherein a single toe strap is used in the yoke assembly.

13. A snowshoe according to claim 12, wherein the heel strap is fixedly secured to one lateral support arm and is adjustably secured to the other lateral support arm by way of a two-stage buckle means.

14. A snowshoe according to claim 13, wherein the toe and heel straps are relatively short with the free ends thereof in a ready-to-use upright mode.

15. A snowshoe according to claim 13, further comprising means including said toe stop member for detachably connecting a crampon to the bottom of the binding means.

16. A snowshoe according to claim 15, wherein said toe stop member extends about the forward end of the sole plate and is provided at its underside with locking means for the crampon, and means pivotally connecting the toe stop member to the sole plate.

17. A snowshoe according to claim 11, further comprising decking means laced to the frame means, and means pivotally supporting said support housing means about a substantially transverse axis to enable pivotal movement of the support housing means.

18. A snowshoe according to claim 17, wherein said decking means is provided with a cutout of such shape as to enable forward pivotal movement of the binding means while preventing rearward pivotal movement by engagement of the sole plate on said decking means.

19. A snowshoe according to claim 13, wherein the heel strap undergoes reversal of direction in the two-stage buckle means so that the free end of the heel strap extends toward the body.

20. A snowshoe according to claim 18, further comprising a two-stage buckle means includes a base portion and eyes on both sides of the base portion with the outer part of each eye offset from the plane of the base portion, a fastening strap for floatingly securing said buckle means at the other lateral support arm with the fastening strap extending through said eyes from above and underneath said base portion so that the free end of the heel strap can extend over said fastening strap underneath the base portion with reversal of direction to return above the base portion and in engagement with a spring-loaded latching means.

21. A snowshoe according to claim 11, wherein said yoke means comprises a plate-like member of predetermined shape which is provided with two pairs of slots, the slots of one pair being disposed in the plate-like member laterally of the slots of the other pair and each slot of the one pair being disposed at a predetermined angle with respect to the next adjacent slot of the other pair.

22. A snowshoe according to claim 21, wherein the predetermined angle is about 45°.

23. A snowshoe according to claim 22, wherein the slots of the other pair are substantially parallel to one another and are disposed on both sides of a center longitudinal plane, and wherein the slots of the other pair converge toward one another in one direction toward the center longitudinal plane.

24. A snowshoe according to claim 21, wherein each slot of said one pair of slots enables a change of direction of the strap passing therethrough from a generally transverse direction to a generally fore-, respectively, aft-direction, and wherein the slots of the other pair of slots provides guidance for the strap passing therethrough in the generally transverse direction.

25. A snowshoe binding providing facilitated entry and exit, comprising a support housing means made of semi-rigid material and having rearwardly extending lateral support arms integral with the support housing means to increase lateral support, toe binding means including a yoke assembly that requires only a single, relatively short toe strap adapted to extend both in the generally transverse as well as generally longitudinal directions by the use of a yoke means operable to permit the strap to remain relatively flat for wearer comfort, a heel strap, means connecting the heel strap to said lateral support arms including buckle means for the free end of the heel strap so that the free end of the heel strap extends toward the snowshoer's body to enable ergonomic cinching of the heel strap, and means to enable facilitated attachment and detachment of a crampon without the use of tools including a pivotal arrangement of a part of the toe binding means.

26. A yoke member which permits lateral as well as fore-and-aft directional cinching of a strap, comprising a plate-like member of predetermined shape which is provided with two pairs of slots, the slots of one pair converging toward one another to define an angle and being disposed in the plate-like member laterally of the slots of the other pair, the other pair of slots being generally parallel to one another and being located at least partially within the area defined by the angularly disposed slots of the one pair, and each slot of the one pair being disposed at a predetermined angle with respect to the next adjacent slot of the other pair.

27. A yoke member according to claim 26, wherein the predetermined angle is about 45°.

28. A yoke member according to claim 26, wherein the slots of the other pair are substantially parallel to one another and are disposed on both sides of a center longitudinal plane, and wherein the slots of the other pair converge toward one another in one direction toward the center longitudinal plane.

29. A yoke assembly according to claim 28, wherein the two pairs of slots are disposed substantially symmetrically with respect to the center longitudinal plane.

30. A yoke assembly according to claim 29, wherein each slot of said one pair of slots enables a change of direction of the strap passing therethrough from a generally transverse direction to a generally fore-, respectively, aft-direction, and wherein the slots of the other pair of slots provides guidance for the strap passing therethrough in the generally transverse direction.

31. A yoke member according to claim 30, wherein said plate-like member is substantially flat and permits the single strap to remain substantially flat.

32. A yoke member according to claim 31, wherein said plate-like member is of generally diamond-shape with the slots of the one pair of slots substantially parallel to the next-adjacent external side of the generally diamond-shaped plate-like member and with each slot of the other pair of slots forming a substantially bisecting angle with the corresponding external side of the angle formed by the intersection of the corresponding external sides.

33. A yoke member according to claim 29, wherein the predetermined angle is about 45°.

34. A yoke assembly according to claim 26, wherein each slot of said one pair of slots enables a change of direction of the strap passing therethrough from a generally transverse direction to a generally fore-, respectively, aft-direction, and wherein the slots of the other pair of slots provides guidance for the strap passing therethrough in the generally transverse direction.

35. A yoke member according to claim 26, wherein said plate-like member is substantially flat and permits the single strap to remain substantially flat.

36. A yoke member according to claim 26, wherein said plate-like member is of generally diamond-shape with the slots of the one pair of slots substantially parallel to the next-adjacent external side of the generally diamond-shaped plate-like member and with each slot of the other pair of slots forming a substantially bisecting angle with the corresponding external side of the angle formed by the intersection of the corresponding external sides.

37. A buckle which provides a two-stage latching action and allows free-flowing strap movement, comprising a buckle base portion having a bottom side and a top side and including eye means at both ends thereof forming openings, latching means fixed to and disposed on the top side of said base portion to define a latching space directly between said top side and said latching means, and the outer portions of said eye means being offset away from the bottom side with respect to a plane including the base portion and the inner eye portions in a direction opposite to the latching means so that a fastening strap for floatingly fastening the buckle can extend underneath the base portion after passing through the eye means from above and another strap can extend through one of the eye means form above into the space between the fastening strap and the bottom side of the base portion and after passing through the other eye means and subsequent reversal of direction, can extend into the space between the top side of the base portion and the latching means and can be latched in the space between the top side of the base portion and the latching means.

38. A buckle according to claim 37, wherein the eye means are integral with the buckle base portion, and wherein the latching means includes a pivotal spring-loaded latching member having a strap-engaging latching surface facing the top side of the buckle base portion.

39. A buckle according to claim 37, wherein the eye means form elongated openings having a length at least approximately equal to the width of the buckle base portion and a width greater than the combined thickness of the fastening strap and of the another strap.

40. A buckle according to claim 39, wherein the offset in each eye means occurs in the middle area of the width of each eye means.

41. A buckle according to claim 40, wherein each elongated opening is delimited by generally rectilinear portions interconnected by rounded-off connecting portions, and wherein the offset occurs in the center areas of the rounded-off connecting portions.

42. A buckle according to claim 39, wherein each elongated opening is delimited by generally rectilinear portions interconnected by rounded-off connecting portions, and wherein the offset occurs in the center areas of the rounded-off connecting portions.

43. A buckle according to claim 41, wherein the eye means are integral with the buckle base portion, and wherein the latching means includes a pivotal spring-loaded latching member having a strap-engaging latching surface facing the top side of the buckle base portion.

44. A yoke member according to claim 26, wherein said plate-like member has at least two sides converging toward one another, the slots of the one pair of slots being at least approximately parallel to the next-adjacent side of the plate-like member, the slots of the other pair of slots being located in the area of the plate-like member which is located inside of the slots of the one pair, and the imaginary extension of each slot of the other pair intersecting the imaginary extension of the next-adjacent slot of the one pair and forming an acute angle so that a strap approaching the plate-like member generally transversely to the slots of the other pair is able to undergo two approximately 90° changes in direction as it passes through the slots of the one pair.

* * * * *